US012807881B2

(12) United States Patent
Maduskar et al.

(10) Patent No.: US 12,807,881 B2
(45) Date of Patent: Nov. 24, 2026

(54) FLUIDIZED BED PLASTIC WASTE PYROLYSIS WITH MELT EXTRUDER

(71) Applicant: ExxonMobil Chemical Patents Inc., Baytown, TX (US)

(72) Inventors: Saurabh S. Maduskar, Houston, TX (US); Jay L. Reimers, Houston, TX (US); Michael W. Weber, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 137 days.

(21) Appl. No.: 17/995,607

(22) PCT Filed: Apr. 7, 2021

(86) PCT No.: PCT/US2021/026176
§ 371 (c)(1),
(2) Date: Oct. 6, 2022

(87) PCT Pub. No.: WO2021/216284
PCT Pub. Date: Oct. 28, 2021

(65) Prior Publication Data

US 2023/0159834 A1 May 25, 2023

Related U.S. Application Data

(60) Provisional application No. 63/014,176, filed on Apr. 23, 2020.

(51) Int. Cl.
*C10G 1/10* (2006.01)
*C10B 49/22* (2006.01)
(Continued)

(52) U.S. Cl.
CPC ..... *C10G 1/10* (2013.01); *C10B 49/22* (2013.01); *C10B 53/07* (2013.01); *C10G 1/002* (2013.01);
(Continued)

(58) Field of Classification Search
CPC . C10G 1/10; C10G 1/002; C10G 9/32; C10G 9/36; C10G 51/06;
(Continued)

(56) References Cited

U.S. PATENT DOCUMENTS 5,326,919 A 7/1994 Paisley et al. ..... 585/241
5,379,705 A * 1/1995 Takada ..... F23G 5/30 422/142
(Continued)

FOREIGN PATENT DOCUMENTS

CN 101230284 7/2008 ..... C08J 11/10
WO WO2018/000050 1/2018 ..... C10G 1/00
(Continued)

OTHER PUBLICATIONS

Zhang et al. "Biomass fast pyrolysis in fluidized bed reactor under N2, CO2, CO, CH4 and H2 atmospheres" Bioresouce Technology 102 (2011) pp. 4258-4264. (Year: 2011).*

*Primary Examiner* — Tam M Nguyen
(74) *Attorney, Agent, or Firm* — C. Tumey Law Group PLLC

(57) ABSTRACT

Systems and methods are provided for conversion of polymers (such as plastic waste) to olefins. The systems and methods can include an initial pyrolysis stage where a plastic feedstock is delivered to the initial pyrolysis stage by one or more melt extruders. The one or more melt extruders can be heated to maintain the plastic feedstock in a liquid state during delivery of the plastic feedstock to the initial pyrolysis stage. This can allow for delivery of the plastic
(Continued)

feedstock into the pyrolysis process with a controlled distribution of plastic into the pyrolysis reactor.

24 Claims, 2 Drawing Sheets

(51) Int. Cl.

| | |
|---|---|
| ***C10B 53/07*** | (2006.01) |
| ***C10G 1/00*** | (2006.01) |
| ***C10G 9/32*** | (2006.01) |
| ***C10G 9/36*** | (2006.01) |
| ***C10G 51/06*** | (2006.01) |

(52) U.S. Cl.
CPC ..... *C10G 9/32* (2013.01); *C10G 9/36* (2013.01); *C10G 51/06* (2013.01); *C10G 2300/1003* (2013.01); *C10G 2300/4081* (2013.01); *C10G 2400/20* (2013.01); *C10G 2400/22* (2013.01)

(58) Field of Classification Search
CPC .... C10G 2300/1003; C10G 2300/4081; C10G 2400/20; C10G 2400/22; C10B 49/22; C10B 53/07
See application file for complete search history.

(56) References Cited

U.S. PATENT DOCUMENTS

| | | | | |
|---|---|---|---|---|
| 5,481,052 | A | 1/1996 | Hardman et al. | 585/241 |
| 9,212,318 | B2 | 12/2015 | Narayanaswamy et al. | C10G 1/10 |
| 9,920,255 | B2 * | 3/2018 | Hofer | C08J 11/12 |
| 2010/0266464 | A1 | 10/2010 | Sipilae et al. | 422/187 |
| 2014/0163152 | A1 * | 6/2014 | Rau | C08J 11/04 524/427 |
| 2015/0080624 | A1 * | 3/2015 | Gephart | C10G 19/00 422/200 |
| 2019/0299491 | A1 * | 10/2019 | Stanislaus | B01J 29/85 |
| 2020/0362248 | A1 * | 11/2020 | Cartolano | C10B 57/06 |
| 2022/0195309 | A1 | 6/2022 | Uppili et al. | C10G 1/10 |

FOREIGN PATENT DOCUMENTS

| | | | |
|---|---|---|---|
| WO | WO2018/069794 | 4/2018 | C10G 45/00 |
| WO | WO2021/080899 | 4/2021 | C10G 69/06 |

* cited by examiner

FLUIDIZED BED PLASTIC WASTE PYROLYSIS WITH MELT EXTRUDER

CROSS-REFERENCE TO RELATED APPLICATIONS

This application claims the priority benefit of U.S. Ser. No. 63/014,176, filed Apr. 23, 2020, which is incorporated herein by reference.

FIELD

Systems and methods are provided for pyrolysis of plastic waste in a fluidized bed environment. The plastic waste is introduced into the pyrolysis environment with a melt extruder.

BACKGROUND

Recycling of plastic waste is a subject of increasing importance. Conventionally, polyolefins in plastic waste are converted by various methods, such as pyrolysis or gasification, to produce energy. While this provides a pathway for using waste plastic a second time, ultimately methods for generation of energy from plastic waste also result in conversion of the plastic waste into $CO_2$. To make the process fully circular, so that the polymers can be recycled for return to the same usage, these pyrolysis and gasification products need to go through further pyrolysis or conversion processes to return them back to the light olefin monomer. The olefin monomers can then be repolymerized back to the polyolefin for use in the same service. Unfortunately, this process to make light olefins is high in energy usage, capital required, and produces relatively low yields of the light olefin monomers. It would be desirable to develop systems and methods that can allow for a circular recycle path for polyolefins with improved olefins yields.

U.S. Pat. No. 5,326,919 describes methods for monomer recovery from polymeric materials. The polymer is pyrolyzed by heating the polymer at a rate of 500° C./second in a flow-through reactor in the presence of a heat transfer material, such as sand. Cyclone separators are used for separation of fluid products from solids generated during the pyrolysis. However, the resulting vapor phase monomer product corresponds to a mixture of olefins, and therefore is not suitable for synthesis of new polymers.

U.S. Pat. No. 9,212,318 describes a catalyst system for pyrolysis of plastics to form olefins and aromatics. The catalyst system includes a combination of an FCC catalyst and a ZSM-5 catalyst.

Chinese Patent CN101230284 describes methods for coking of plastic waste. The plastic waste is pulverized to form small particles. The resulting particles are fluidized using a screw extrusion conveyor, followed by heating and extrusion to convert the plastic waste into a semi-fluid state. The heated and extruded plastic waste is then stored at a temperature of 290° C. to 320° C. to maintain the plastic in a liquid state. The liquid plastic waste is then pumped into the coker furnace.

SUMMARY

In various aspects, a method for producing olefins is provided. The method includes melting a plastic feedstock comprising plastic particles of at least one polymer in a melt extruder. The method further includes transferring the melted plastic feedstock from the melt extruder to a pyrolysis reactor. The method further includes pyrolyzing the transferred plastic feedstock in a fluidized bed of heat transfer particles in the pyrolysis reactor at a temperature of 400° C. or more to form a pyrolysis effluent. The method further includes cooling the pyrolysis effluent to form a cooled pyrolysis effluent; separating the cooled pyrolysis effluent to form a gas phase fraction and a liquid phase fraction. Additionally, the method includes performing a second thermal cracking on a) at least a portion of the gas phase fraction, b) at least a portion of the liquid phase fraction, or c) a combination thereof, in a second thermal cracking stage to form an olefin-containing effluent.

In various aspects, a system for olefin production is provided. The system includes a physical processing stage for forming a plastic feedstock comprising plastic particles. The system further includes a melt extruder in fluid communication with the physical processing stage via a transfer conduit. The system further includes a pyrolysis reactor comprising a pyrolysis inlet and a pyrolysis outlet, the pyrolysis reactor being in fluid communication with the melt extruder at an interface between the transfer conduit and the pyrolysis inlet, the interface comprising an extrusion die. The system further includes a regenerator in fluid communication with the pyrolysis reactor. The system further includes a cooling stage in fluid communication with the pyrolysis outlet. The system further includes a separation stage comprising a separation stage inlet, a gas effluent outlet, and a liquid effluent outlet, the separation stage inlet being in fluid communication with the cooling stage. Additionally, the system includes a steam cracking reactor comprising a reactor inlet and a reactor outlet, the reactor inlet being in fluid communication with at least one of the gas effluent outlet and the liquid effluent outlet.

DETAILED DESCRIPTION

Figure 1:
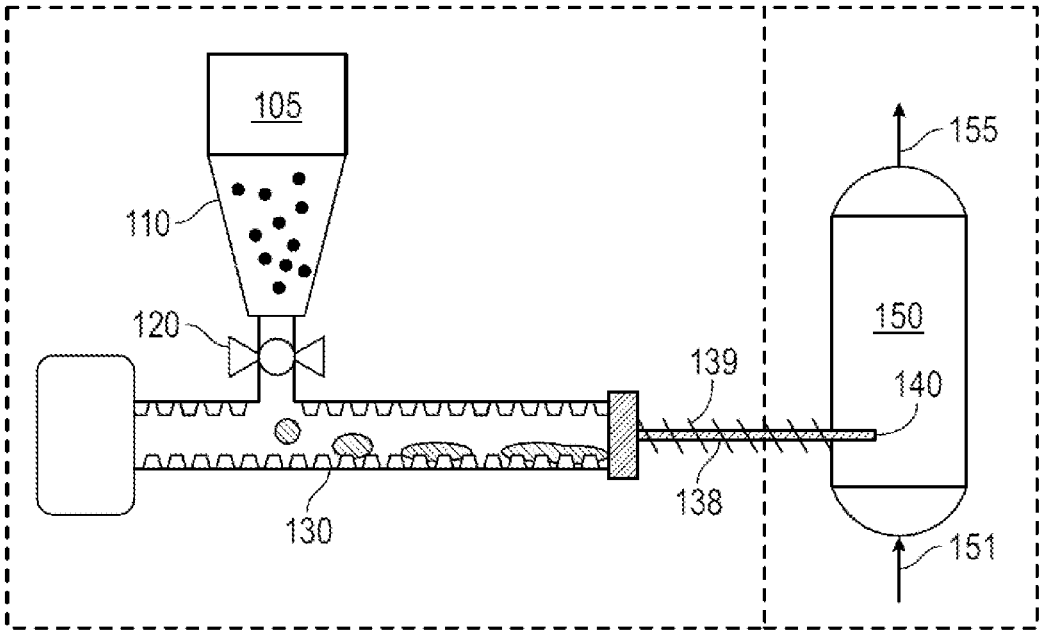
FIG. 1 shows an example of a pyrolysis reactor that is fed by a melt extruder.

All numerical values within the detailed description and the claims herein are modified by "about" or "approximately" the indicated value, and take into account experimental error and variations that would be expected by a person having ordinary skill in the art.

In various aspects, systems and methods are provided for conversion of polymers (such as plastic waste) to olefins. The systems and methods can include an initial pyrolysis stage where a plastic feedstock is delivered to the initial pyrolysis stage by one or more melt extruders. The one or more melt extruders can be heated to maintain the plastic feedstock in a liquid state during delivery of the plastic feedstock to the initial pyrolysis stage. This can allow for delivery of the plastic feedstock into the pyrolysis process with a controlled distribution of plastic into the pyrolysis reactor. The mass flow rate of plastic into the initial pyrolysis reactor can be controlled by the rotation rate of the extruder mechanism of the melt extruder.

One of the difficulties with processing a polymer-based feedstock by pyrolysis, such as a plastic waste feedstock, is managing the input flow of the feedstock into the pyrolysis reactor. Various types of plastics, such as polyolefins, have melting points that are well below typical pyrolysis temperatures. As a result, when using conventional methods for introducing plastic into a pyrolysis reactor, the plastic feedstock can end up in a mixed state corresponding to some solid phase plastic and some (melted) liquid phase plastic. Having a mixed phase feed can present difficulties, as a feeding mechanism that is suitable for moving solid phase particles can often have limited effectiveness for moving liquid phase materials. Similarly, a feeding mechanism that is suitable for moving liquid phase material can often have difficulty with transport of solid particles.

In various aspects, the above difficulties can be overcome in part by passing the plastic feedstock into the pyrolysis reactor as plastic particles that are injected using a melt extruder. By using a melt extruder, with optional additional heating of the extruder barrel, the plastic particles can be delivered to the pyrolysis reactor in a liquid state. Additional heat can also be added to the melted plastic feedstock by heating the barrel of the melt extruder. For example, heat tracing can be used to allow for electric heating of the melt extruder barrel.

In a melt extruder, plastic is melted and formed into a continuous phase that can then be conveyed as a conventional feedstock similar to a hydrocarbon stream. By using a melt extruder as a feeder for a pyrolysis reaction, plastic waste can be homogenized into molten plastics and can be distributed in pyrolysis reactor. The distribution of molten plastic can facilitate efficient mixing, heating, and/r mass transfer in the fluidized bed reactor. Also, as heat required to melt the plastics is provided electrically in the extruder, the overall heat load on the reactor is reduced. In some aspects, the conduit connecting the extruder to the reactor can be heated in order to maintain the polymer in a molten phase.

The effluent from the initial pyrolysis stage can the undergo further processing, such as contaminant removal followed by removal of high molecular weight components. The processed portion of the effluent can then be used as at least part of the feedstock for a secondary cracking process for olefin production, such as steam cracking.

In this discussion, a reference to a "$C_x$" fraction, stream, portion, feed, or other quantity is defined as a fraction (or other quantity) where 50 wt % or more of the fraction corresponds to hydrocarbons having "x" number of carbons. When a range is specified, such as "$C_x$-$C_y$", 50 wt % or more of the fraction corresponds to hydrocarbons having a number of carbons between "x" and "y". A specification of "$C_{x+}$" (or "$C_{x-}$") corresponds to a fraction where 50 wt % or more of the fraction corresponds to hydrocarbons having the specified number of carbons or more (or the specified number of carbons or less).

Plastic Feedstock

In various aspects, a plastic feedstock for pyrolysis can include or consist essentially of one or more types of polymers, such as polymers corresponding to plastic waste. The systems and methods described herein can be suitable for processing plastic waste corresponding to a single type of olefinic polymer and/or plastic waste corresponding to a plurality of olefinic polymers. In aspects where the feedstock consists essentially of polymers, the feedstock can include one or more types of polymers as well as any additives, modifiers, packaging dyes, and/or other components typically added to a polymer during and/or after formulation. The feedstock can further include any components typically found in polymer waste.

In some aspects, the polymer feedstock can include at least one of polyethylene and polypropylene. The polyethylene can correspond to any convenient type of polyethylene, such as high density or low density versions of polyethylene. Similarly, any convenient type of polypropylene can be used. In addition to polyethylene and/or polypropylene, the plastic feedstock can optionally include one or more of polystyrene, polyvinylchloride, polyamide (e.g., nylon), polyethylene terephthalate, and ethylene vinyl acetate. Still other polyolefins can correspond to polymers (including co-polymers) of butadiene, isoprene, and isobutylene. In some aspects, the polyethylene and polypropylene can be present in the mixture as a co-polymer of ethylene and propylene. More generally, the polyolefins can include co-polymers of various olefins, such as ethylene, propylene, butenes, hexenes, and/or any other olefins suitable for polymerization.

In this discussion, unless otherwise specified, weights of polymers in a feedstock correspond to weights relative to the total polymer content in the feedstock. Any additives/modifiers/other components included in a formulated polymer are included in this weight. However, the weight percentages described herein exclude any solvents or carriers that might optionally be used to facilitate transport of the polymer into the initial pyrolysis stage.

In aspects where the plastic feedstock includes less than 100 wt % of polyethylene and/or polypropylene, the plastic feedstock can optionally include 0.01 wt % or more of other polymers, or 0.1 wt % or more of other polymers. For example, in some aspects the plastic feedstock can include 0.01 wt % to 35 wt % of polystyrene, or 0.1 wt % to 35 wt %, or 1.0 wt % to 35 wt %, or 0.01 wt % to 20 wt %, or 0.1 wt % to 20 wt %, or 1.0 wt % to 20 wt %, or 10 wt % to 35 wt %, or 5 wt % to 20 wt %.

In some aspects, the plastic feedstock can optionally include 0.01 wt % to 10 wt %, or 0.1 wt % to 10 wt %, or 0.01 wt % to 2.0 wt %, or 0.01 wt % to 1.0 wt % of polyvinyl chloride, polyvinylidene chloride, or a combination thereof; and/or 0.1 wt % to 1.0 wt % polyamide. Polyvinyl chloride is roughly 65% chlorine by weight. As a result, pyrolysis of polyvinyl chloride (and/or polyvinylidene chloride) can result in formation of substantial amounts of hydrochloric acid relative to the initial weight of the polyvinyl chloride. In limited amounts, the hydrochloric acid that results from pyrolysis of polyvinyl chloride and/or polyvinylidene chloride can be removed using guard beds prior the secondary cracking stage. Additionally or alternately, calcium oxide particles can be added to the heat transfer particles in the pyrolysis reactor. With regard to polyamide, pyrolysis results in formation of $NO_x$. Limiting the amount of $NO_x$ can simplify any downstream handling of the contaminants removed from the pyrolysis effluent.

In various aspects, the plastic waste can be prepared for introduction as a plastic feedstock into the melt extruder. Depending on the nature of the plastic feedstock, this can include using one or more physical processes to convert the plastic feedstock into particles and/or to reduce the particle size of the plastic particles.

For plastic waste feedstock that is not initially in the form of particles, a first processing step can be a step to convert the plastic feedstock into particles and/or to reduce the particle size. This can be accomplished using any convenient type of physical processing, such as chopping, crushing, grinding, shredding or another type of physical conversion of plastic solids into particles. It is noted that it may be desirable to convert plastic into particles of a first average and/or median size, followed by additional physical processing to reduce the size of the particles.

Having a small particle size can facilitate uniform melting of plastic within the melt extruder in a desirable time frame. Thus, physical processing can optionally be performed to reduce the median particle size of the plastic particles to 3.0 cm or less, or 2.5 cm or less, or 2.0 cm or less, or 1.0 cm or less, such as down to 0.01 cm or possibly still smaller. For determining a median particle size, the particle size is defined as the diameter of the smallest bounding sphere that contains the particle.

The plastic particles can then be passed into the melt extruder. In some aspects, sufficient heat can be provided by the mechanical action of the melt extruder to convert the plastic particles into a liquid (melted) state. In some aspects, the temperature of the plastic during extrusion can be 150° C. or more, or 170° C. or more, such as up to 350° C. or possibly still higher, to ensure melting of the plastic. Additionally or alternately, the temperature of the plastic during extrusion can be greater than the highest melting point of a polymer in the plastic feedstock.

After extrusion, the extruded plastic can be transferred to the pyrolysis reactor via a transfer conduit. Optionally, an extrusion die can be included at the interface between the transfer conduit and the pyrolysis reactor. In some aspects, the transfer conduit can be heated to assist with maintaining the plastic in a liquid state as the plastic is passed into the pyrolysis reactor. Increasing the temperature can also reduce the viscosity of the plastic feedstock, which can reduce the pressure required to pass the plastic feedstock into the pyrolysis reactor. In such aspects, the transfer conduit can be heated so that the temperature of the plastic feedstock in the transfer conduit is 200° C. or more, or 230° C. or more, or 260° C. or more, such as up to 350° C. or possibly still higher.

In addition to or as an alternative to increasing the temperature of the plastic feedstock to reduce viscosity, an additional hydrocarbon stream can be added to the melted plastic (before or after initial extrusion) to reduce the viscosity of the melted plastic feedstock. An example of a suitable hydrocarbon stream can be a recycled portion of the liquid effluent from the initial pyrolysis reactor and/or a recycled portion of liquid effluent from the second thermal cracking stage. As an example of recycle of liquid from the initial pyrolysis reactor, a highest boiling or bottoms portion of the pyrolysis effluent can be recycled. This can be beneficial for taking a portion of the pyrolysis effluent that may not be suitable for processing in the second thermal cracking stage. These high boiling components can then be converted to lower boiling components that are suitable for input to the second thermal cracking stage. Using a portion of the liquid effluent from the second thermal cracking stage can be beneficial, since the desired product from the reaction system is olefins. Recycling a portion of the liquid effluent from the second thermal cracking stage can allow liquid effluent to pass through the pyrolysis and second thermal cracking stages again, and therefore produce a higher yield of olefins per amount of fresh plastic feedstock. In aspects where a liquid recycle stream is added to the plastic feedstock, the combined plastic feedstock and liquid recycle stream can include 75 wt % to 95 wt % of plastic feedstock and 5.0 wt % to 25 wt % of liquid recycle stream.

Optionally, the plastic feedstock can be extruded at a plurality of locations within the melt extruder. For example, an extrusion die could be included at the interface between the melt extruder and the pyrolysis reactor, such as a die to form small plastic rods. Even though the plastic is in a liquid state, performing an additional extrusion at the interface with the pyrolysis reactor can facilitate transfer of heat into the plastic to allow for rapid heating to the desired pyrolysis temperature.

Due to the melting of the plastic within the melt extruder, a gas phase component may be evolved in the melt extruder. The evolved gas phase can correspond to, for example, additives and/or contaminants trapped within the solid plastic that are released by the melting phase transition. Due to the potential for gas evolution, a degassing exhaust line can be included in the melt extruder to prevent the buildup of gases during operation.

In various aspects, the melt extruder can be oriented to introduce the plastic particles into the pyrolysis reactor in a direction that is substantially horizontal (i.e., substantially perpendicular) relative to the direction of gravitational force. For a fluidized bed pyrolysis reactor, this will typically mean introducing the plastic particles horizontally into the reactor relative to the vertical orientation of the fluidized bed.

Any convenient number of melt extruders can be used to introduce the plastic feedstock into the initial pyrolysis stage. Using multiple melt extruders can potentially assist with evenly distributing the delivery of the plastic feed into the pyrolysis reactor. Additionally or alternately, use of multiple melt extruders can increase the total flow rate of plastic feedstock into the pyrolysis reactor.

The mass flow rate of plastic feedstock through the melt extruder and into the pyrolysis reactor can be controlled by another mechanism. For example, the particles can be metered into a melt extruder at a desired mass flow rate using a lock hopper with a series of valves or another gravity feed mechanism.

A variety of options are available for the location of the interface between the melt extruder(s) and the initial pyrolysis reactor. In some aspects, a plurality of melt extruders can be used. In such aspects, the plurality of melt extruders can be arranged around the pyrolysis reactor to improve distribution of the plastic in the pyrolysis reactor. Optionally, the plurality of melt extruders can be arranged in a substantially symmetric manner around the circumference of the pyrolysis reactor.

The interface of the melt extruder(s) with the pyrolysis reactor can be above the level of the fluidized bed; within the height of the fluidized bed; or below the level of the fluidized bed. In some aspects, introducing the plastic feedstock above the top of the fluidized bed can assist with maintaining an even distribution of plastic feedstock in the fluidized bed. In other aspects, other choices for location can be beneficial. For example, another option can be to have the input location for the plastic feedstock near the input location for the heated heat transfer particles that provide the input heat to maintain temperature in the fluidized bed. Locating the input for the plastic feedstock near an input location for heat transfer particles can assist with heating the feedstock quickly to the desired pyrolysis temperature. In aspects where a plurality of melt extruders are used, the plurality of melt extruders can optionally interface with the pyrolysis reactor at substantially the same height relative to the fluidized bed. This can be beneficial for maintaining a similar residence time in the fluidized bed for plastic introduced from each melt extruder.

Processing Conditions—Initial Pyrolysis Stage

In various aspects, the plastic feedstock can be fed from the screw feeder into a fluidized bed pyrolysis reactor. After exiting from the screw feeder, the feedstock is heated to a temperature between 400° C.-900° C., or 500° C.-900° C., or 400° C.-700° C., or 550° C. to 700° C., or 400° C.-500° C., for a reaction time to perform pyrolysis. The temperature can depend in part on the desired products. In aspects where a portion of the pyrolysis effluent will be exposed to a second thermal cracking stage, lower temperatures can be used in order to increase the yield of liquid phase products. In some aspects, the reaction time where the feedstock is maintained at or above 500° C. can be limited in order to reduce or minimize formation of coke. In some aspects, the reaction time can correspond to 0.1 seconds to 6.0 seconds, or 0.1 seconds to 5.0 seconds, or 0.1 seconds to 1.0 seconds, or 1.0 seconds to 6.0 seconds, or 1.0 seconds to 5.0 seconds. The pyrolyzed feedstock is cooled to below 500° C. at the end of the reaction time.

In some aspects, diluent steam can also be fed into the pyrolysis reactor. The steam also serves as a fluidizing gas. In aspects where additional diluent steam is added, the weight ratio of steam to plastic feedstock can be between 0.3:1 to 10:1.

In some aspects, the pyrolysis reactor can correspond to a fluidized bed reactor. The fluidized bed can correspond to a fluidized bed of heat transfer particles. Sand is an example of a suitable type of particle for the fluidized bed, although any convenient type of particle can be used. During operation, heated heat transfer particles can be passed into the pyrolysis reactor to provide heat for the reaction. The feedstock can be introduced separately, to avoid melting of the plastic feedstock. A separate fluidizing gas can also be introduced at the bottom of the reactor to maintain the fluidized bed conditions.

The pyrolysis product can correspond to a gas phase product at the temperatures of the fluidized bed. As a result, the pyrolysis product can be withdrawn from the top of the reactor, while cooled heat transfer particles (such as cooled sand) can be withdrawn from a location near the bottom of the fluidized bed. After exiting from the pyrolysis reactor, the heat transfer particles can be separated from the vapor portions of the pyrolyzed effluent using a cyclone or another solid/vapor separator. Such a separator can also remove any other solids present after pyrolysis. Optionally, in addition to a cyclone or other primary solid/vapor separator, one or more filters can be included at a location downstream from the cyclone to allow for removal of fine particles that become entrained in the vapor phase. The cooled heat transfer particles can be passed into a regenerator to burn off coke and heat the particles, which are then returned to the reactor to provide the heat for pyrolysis. Depending on the amount of coke on the heat transfer particles, addition fuel can optionally be combusted in the regenerator to sufficiently increase the temperature of the heat transfer particles for maintenance of temperature in the fluidized bed of the pyrolysis reactor. The temperature of the heat transfer particles when leaving the regenerator can be greater than the desired temperature in the fluidized bed of the pyrolysis reactor by 50° C. or more, or 100° C. or more, such as up to 200° C. or possibly still greater.

One of the difficulties with pyrolysis of plastic waste (and/or other polymers) can be handling chlorine that is evolved during pyrolysis, such as chlorine derived from pyrolysis of polyvinyl chloride and/or polyvinylidene chloride. In some aspects, the production of chlorine in the pyrolysis reactor can be mitigated by including a calcium source in the heat transfer particles, such as including calcium oxide particles. Within the pyrolysis environment, calcium oxide can react with chlorine generated during pyrolysis to form calcium chloride. This calcium chloride can then be purged from the system as part of a purge stream for the heat transfer particles. A corresponding make-up stream of fresh heat transfer particles can be introduced to maintain a desired amount of the heat transfer particles in the polyolefin pyrolysis stage.

The pyrolysis effluent generated from pyrolysis of the plastic feedstock can include hydrocarbons with a range of boiling points. The pyrolysis effluent can generally include hydrocarbons ranging from $C_1$ compounds (methane) up to $C_{60}$ compounds or possibly compounds including still higher numbers of carbon atoms.

In some aspects, the pyrolysis can be operated under conditions that allow a substantial portion of the pyrolysis effluent to correspond to higher boiling compounds. For example, the pyrolysis effluent (according to ASTM D2887) can have a T50 distillation point of 100° C. or more, or 200° C. or more, or 250° C. or more. Additionally or alternately, the pyrolysis effluent can have a T70 distillation point of 450° C. or less, or a T80 distillation point of 450° C. or less, or a T90 distillation point of 450° C. or less. Further additionally or alternately, the yield of $C_{4-}$ olefins can also be relatively low, corresponding to 10 wt % or less of the pyrolysis effluent, or 8 wt % or less, or 5 wt % or less.

Additional Processing of Pyrolysis Effluent

After removing solids, the products can be cooled using a heat exchanger, a quench stream, or another convenient method to a temperature of 300° C. to 400° C. to stop the reaction. Optionally, further cooling and/or quenching can also be performed. For example, the pyrolysis effluent can be sufficiently cooled so that a liquid phase fraction of the pyrolysis effluent includes a majority of the 350° C.+ products in the pyrolysis effluent. In some aspects, the cooling can be performed using a quench stream. The quench stream can be a recycle stream from another portion of the processing system, or a stream from a different processing system. For example, if the second thermal cracking process generates a distillate boiling range product (such as steam cracker gas oil), a portion of such a distillate boiling range product can be used as a quench stream. The pyrolysis effluent can then be passed into a gas-liquid separator to separate a gas phase fraction of the pyrolysis effluent from the liquid phase fraction of the pyrolysis effluent.

Performing a gas-liquid separation on the pyrolysis effluent can provide several benefits. First, a variety of contaminant gases can be evolved under pyrolysis conditions, depending on the nature of the plastic feedstock. Such contaminant gases can include, but are not limited to, $H_2S$, $NH_3$, HCl, and various other light gases that can be formed from polymers that include atoms other than carbon and hydrogen. Performing a gas-liquid separation on the pyrolysis effluent can reduce the volume of pyrolysis effluent that needs to be passed through one or more contaminant removal stages in order to remove such contaminant gases. A guard bed (or group of guard beds) an example of a type of contaminant removal stage. A water wash, optionally at acidic or basic conditions, is another example of a type of contaminant removal stage.

Polymers can include a variety of contaminants that are present in larger quantities than crude oil fractions typically used as feed for steam cracking (or other types of pyrolysis). This can include contaminants such as chlorine that are substantially not present in typical crude oil fractions. This can also include contaminants such as oxygen and nitrogen that may be present in elevated amounts in a polyolefin feed. Some contaminants can correspond to components of the underlying polyolefin, such as the chlorine in polyvinyl chloride or the nitrogen in polyamine. Other contaminants can be present due to additives that are included when making a formulated polymer and/or due to packaging, adhesives, and other compounds that become integrated with the polyolefins after formulation. Such additives, packaging, adhesives, and/or other compounds can include additional contaminants such as chlorine, mercury, and/or silicon.

Prior to combining the pyrolysis effluent with a feed for secondary thermal cracking, one type of contaminant removal can be use of a water wash for chlorine removal. Optionally, the water wash can correspond to an amine wash and/or a caustic wash. Using an amine wash and/or a caustic wash can assist with removal of chlorine as well as other contaminants, such as $CO_2$. Another option for performing an amine wash can be to include amines in the quench oil for the initial quench of pyrolysis and/or steam cracker effluent. This can allow a subsequent water wash to remove chlorine.

Additionally or alternately, an additional guard bed can be included for removal of Cl and/or HCl. In aspects where the polyolefin feed includes 2.0 wt % or less of polyvinyl chloride and/or polyvinylidene chloride, a guard bed for removal of chlorine compounds can be suitable for chlorine removal. Examples of suitable guard bed particles for chlorine removal include calcium oxide, magnesium oxide, zinc oxide, and combinations thereof.

Still another type of guard bed can correspond to a guard bed for removal of ammonia. In addition to nitrogen-containing polymers such as polyamines, various types of polymer additives can include nitrogen. In a pyrolysis environment, a portion of this nitrogen can be converted to ammonia. Various types of adsorbents are available for removal of ammonia, such as molecular sieve base adsorbents.

A fixed bed mercury trap can also be included as part of the contaminant removal stage(s). The elevated temperatures present in a pyrolysis reaction environment can convert any mercury present in the polyolefin feed into elemental mercury. Such elemental mercury can then be removed using a guard bed. It is noted that some guard beds suitable for mercury removal can also be suitable for silicon removal. Examples of such guard beds include guard beds including refractory oxides with transition metals optionally supported on the surface, such as the oxides and metals used in demetallization catalysts or a spent hydrotreating catalysts. Additionally or alternately, separate guard beds can be used for silicon and mercury removal, or separate adsorbents for silicon removal and mercury removal can be included in a single guard bed. Examples of suitable mercury adsorbents and silicon adsorbents can include, but are not limited to, molecular sieves that are suitable for adsorption of mercury and/or silicon.

After separation of contaminant gases, a remaining portion of the gas phase fraction can be passed to a second thermal cracking process, such as a steam cracking process. For example, after removal of contaminants, a $C_{5+}$ fraction of the gas phase pyrolysis effluent can be passed into the second thermal cracking process, or a $C_{2+}$ fraction, or possibly substantially all of the remaining gas phase pyrolysis effluent.

In some aspects, after separating the gas phase pyrolysis effluent to form a higher boiling fraction and a lower boiling fraction (such as a $C_{5+}$ fraction and a lower boiling fraction, or a $C_{2+}$ fraction and a lower boiling fraction), the lower boiling fraction can be used as a recycle stream. For example, at least a portion of the lower boiling fraction can be returned to the initial pyrolysis reactor as a fluidizing gas stream. Additionally or alternately, at least a portion of the lower boiling fraction can be used as a sweep gas in the screw feeder.

Additionally, by separating out a liquid phase portion, any 450° C.+ components in the pyrolysis effluent can be separated into the liquid phase portion. The 450° C.+ components can then be separated from the liquid portion, such as by vacuum distillation. More generally, the liquid phase portion can be exposed to a convenient type of process for removal of high molecular weight components. This can make the remainder of the liquid phase portion suitable as a feed in aspects where the second thermal cracking process is a steam cracking process and/or or another type of process where it is desirable to limit the amount of high boiling/high molecular weight components in the feed.

In aspects where a high boiling and/or high molecular weight fraction is separated from the liquid phase effluent, at least a portion of the high boiling and/or high molecular weight fraction can be recycled back to the pyrolysis reactor. This can allow the highest boiling portion of the pyrolysis effluent to be recycled for further pyrolysis.

Optionally, contaminant removal can also be performed on the liquid fraction. Silicon is another commonly found element in additives used in polymer formulation. After pyrolysis, the silicon typically is separated into a liquid product. A silicon trap can be added to the process train for the liquid portion of the pyrolysis effluent to remove silicon.

After contaminant removal, at least a portion of the gas phase fraction of the pyrolysis effluent can be exposed to secondary thermal cracking conditions for olefin production. Similarly, after separation of high boiling (and/or high molecular weight) components, at least a portion of the liquid phase fraction of the pyrolysis effluent can be exposed to secondary thermal cracking conditions for olefin production. In some aspects, exposing the gas phase fraction and/or the liquid phase fraction to the secondary thermal cracking conditions can be optional.

Secondary Thermal Cracking Conditions—Steam Cracking

Steam cracking is an example of a pyrolysis process that can be used as the secondary thermal cracking process for olefin production. In various aspects, the input flow to the secondary thermal cracking process can correspond to a mixture of a portion of the effluent from the first pyrolysis process and a conventional liquid steam cracker feed. In some aspects, the conventional liquid steam cracker feed can be mixed with the portion of the effluent from the first pyrolysis process prior to entering the steam cracking stage. In other aspect, mixing can occur within the steam cracking stage.

Conventionally, a liquid feed for steam cracking can correspond to any type of liquid feed (i.e., feed that is liquid at 20° C. and 100 kPa-a, as defined herein). Examples of suitable reactor feeds can include whole and partial crudes, naphtha boiling feeds, distillate boiling range feeds, reside boiling range feeds (atmospheric or vacuum), or combinations thereof. Additionally or alternately, a suitable feed can have a T10 distillation point of 100° C. or more, or 200° C. or more, or 300° C. or more, or 400° C. or more, and/or a suitable feed can have a T95 distillation point of 450° C. or less, or 400° C. or less, or 300° C. or less, or 200° C. or less. It is noted that the feed for steam cracking can be fractionated to remove a bottoms portion prior to performing steam cracking so that the feed entering the reactor has a T95 distillation point of 450° C. or less. The distillation boiling range of a feed can be determined, for example, according to ASTM D2887. If for some reason ASTM D2887 is not suitable, ASTM D7169 can be used instead. Although certain aspects of the invention are described with reference to particular feeds, e.g., feeds having a defined T95 distillation point, the invention is not limited thereto, and this description is not meant to exclude other feeds within the broader scope of the invention.

A steam cracking plant typically comprises a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing burners. Flue gas from the radiant section is conveyed out of the radiant section to the convection section. The flue gas flows through the convection section and can then be optionally treated to remove combustion by-products such as $NO_x$. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C., (ii) a pressure in the range of from 1.0 to 5.0 bars (absolute), or (iii) a cracking residence time in the range of from 0.10 to 0.5 seconds.

Steam cracking effluent is conducted out of the radiant section and is quenched, typically with water or quench oil. The quenched steam cracking effluent is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, steam cracker tar, water, light saturated hydrocarbon, and molecular hydrogen.

Steam cracking feed typically comprises hydrocarbon and steam, such as 10.0 wt % or more hydrocarbon, based on the weight of the steam cracking feed, or 25.0 wt % or more, or 50.0 wt % or more, or 65 wt % or more, and possibly up to 80.0 wt % or possibly still higher. Although the hydrocarbon can comprise one or more light hydrocarbons such as methane, ethane, propane, butane etc., it can be particularly advantageous to include a significant amount of higher molecular weight hydrocarbon. Using a feed including higher molecular weight hydrocarbon can decrease feed cost, but can also increase the amount of steam cracker tar in the steam cracking effluent. In some aspects, a suitable steam cracking feed can include 10 wt % or more, or 25.0 wt % or more, or 50.0 wt % or more (based on the weight of the steam cracking feed) of hydrocarbon compounds that are in the liquid and/or solid phase at ambient temperature and atmospheric pressure, such as up to having substantially the entire feed correspond to heavier hydrocarbons.

The hydrocarbon portion of a steam cracking feed can include 10.0 wt % or more, or 50.0 wt % or more, or 90.0 wt % or more (based on the weight of the hydrocarbon) of one or more of naphtha, gas oil, vacuum gas oil, waxy residues, atmospheric residues, residue admixtures, or crude oil, such as up to substantially the entire feed. Such components can include those containing 0.1 wt % or more asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms. One or more vapor-liquid separators can be used upstream of the radiant section, e.g., for separating and conducting away a portion of any non-volatiles in the crude oil or crude oil components. In certain aspects, such a separation stage is integrated with the steam cracker by preheating the crude oil or fraction thereof in the convection section (and optionally by adding of dilution steam), separating a bottoms steam comprising non-volatiles, and then conducting a primarily vapor overhead stream as feed to the radiant section.

After performing secondary thermal cracking (such as steam cracking), olefins can be recovered from the secondary thermal cracking effluent by any convenient method. For example, various separations can be performed to separate $C_2$, $C_3$, and/or $C_4$ olefins from the secondary thermal cracking effluent.

Configuration Examples

FIG. 1 depicts a melt extruder system for introducing a plastic feedstock horizontally into the side of a pyrolysis reactor. In FIG. 1, a (solid) plastic feedstock 105 is stored in a hopper 110. The plastic feedstock 105 is introduced to the melt extruder 130 through a conventional hopper feeder 120. The solid plastic particles of the plastic feedstock 105 can fall into the melt extruder 130 through the force of gravity. The particles are extruded in melt extruder 130 and then passed into transfer conduit 138. Optionally, the transfer conduit 138 from the extruder to the reactor can be heated 139 to ensure the molten plastic does not freeze as it is pushed into the pyrolysis reactor 150. In the example shown in FIG. 1, an extrusion die 140 is included at the interface between the transfer conduit and the pyrolysis reactor 150, to form small extruded shapes of the plastic feedstock to facilitate rapid heat transfer. A fluidizing gas 151 can be introduced into the reactor 150 to maintain fluidized bed conditions in the reactor 150. The fluidized bed can correspond to a fluidized bed of heat transfer particles (not shown) that provide the heat required for performing the pyrolysis reaction. This generates a pyrolysis effluent 155 that can undergo various types of further processing.

Figure 2:
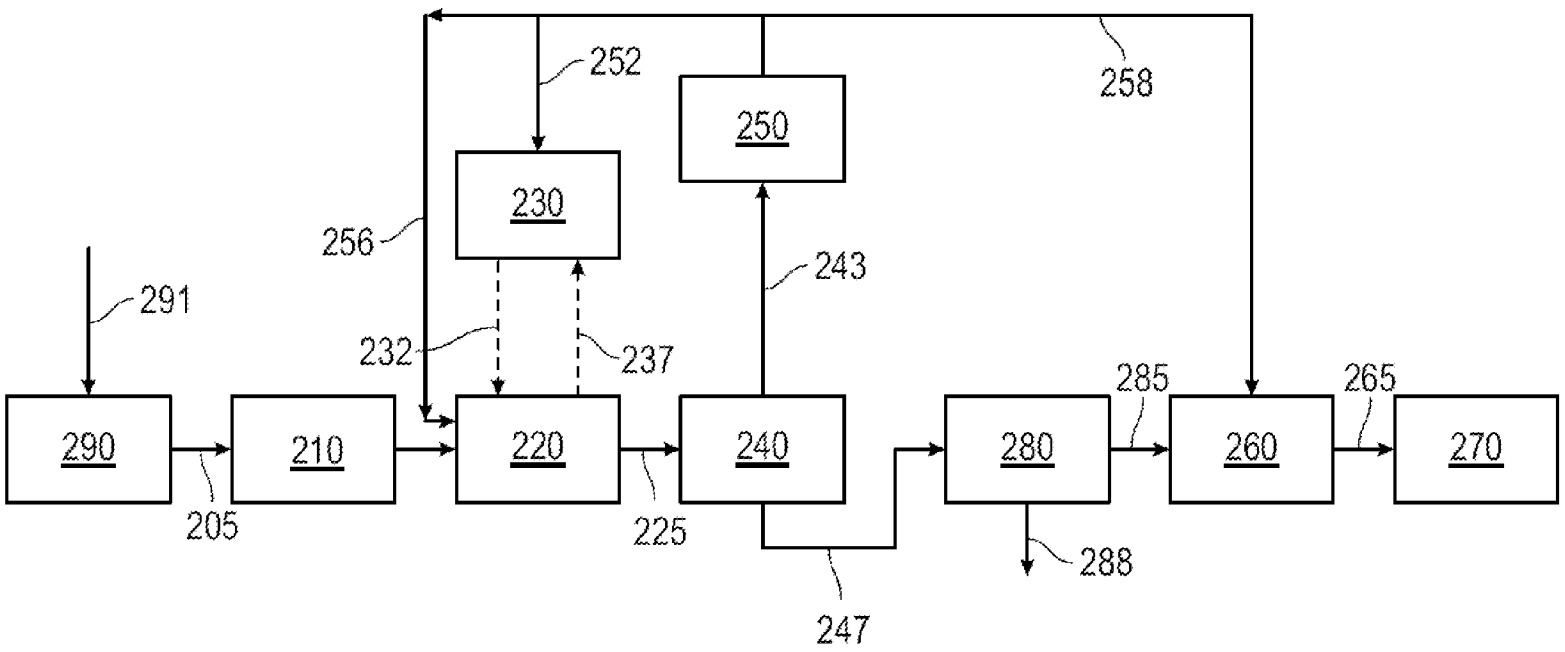
FIG. 2 shows an example of a process configuration for conversion of a plastic feedstock into olefins via pyrolysis followed by a second thermal cracking stage.

FIG. 2 shows an example of integrating an initial pyrolysis stage that is fed by a melt extruder with a secondary thermal cracking process for olefin production. In FIG. 2, an initial feed of polymers and/or plastic 291 (optionally including other contaminants) is exposed to one or more pre-treatment processes 290 for preparing a plastic feedstock 205. The one or more pre-treatment processes 290 can include processes for forming plastic particles, physical processes for modifying plastic particle sizes, and/or any other convenient processes for preparing a plastic 205 feedstock that is suitable for entry into a melt extruder 210. The melt extruder 210 passes the plastic feedstock 205 into one or more pyrolysis reactors 220. Although a line is shown in FIG. 2 between melt extruder 210 and the one or more pyrolysis reactors 220, the melt extruder 210 can have an interface with pyrolysis reactors 220 without passing through an intervening conduit.

In addition to plastic feedstock 205, pyrolysis reactor(s) 220 also receive heated heat transfer particles 232 for heating a fluidized bed (or beds) within the pyrolysis reactors. Regenerator 230 receives cooled heat transfer particles 237 from pyrolysis reactor 220. Heat is generated in regenerator 230 by burning coke off of the cooled heat transfer particles 237. A stream of heated heat transfer particles 232 is then returned to pyrolysis reactor 220. Optionally, additional fuel can be burned in regenerator 230 to provide sufficient heat for maintaining the temperature in the one or more pyrolysis reactors 220. One potential source of that additional fuel can be a recycle stream 252 of light hydrocarbons that are separated out as part of the separations in contaminant removal stage 250. Additionally or alternately, a portion of the light hydrocarbons from contaminant removal can be returned 256 to the pyrolysis stage for use as a fluidizing gas.

The pyrolysis reactor(s) 220 can convert the plastic feedstock 205 into a pyrolysis effluent 225. Initially, substantially all of the pyrolysis effluent is typically in the gas phase, due to the relatively high temperatures in the pyrolysis reactor(s). The pyrolysis effluent 225 can then be passed into a gas-liquid separation stage 240. The gas-liquid separation stage can include one or more initial quenches or other cooling steps so that the pyrolysis effluent 225 includes a gas phase fraction and a liquid phase fraction. The gas-liquid separation stage 240 can then separate at least one gas phase fraction 243 from at least one liquid phase fraction 247.

The gas phase fraction 243 can be passed into a contaminant removal stage 250. Contaminant removal stage 250 can include one or more processes and/or structures (such as guard beds) for removal of gas phase contaminants. This can include processes and/or structures for removal of chlorine, nitrogen, mercury, and/or other compounds different from hydrocarbons. Optionally, contaminant removal stage can further include at least one separator for separating a stream containing light (i.e., lower boiling) hydrocarbons from a higher boiling portion 258. At least a portion of the stream containing the light hydrocarbons can be used, for example, as recycle stream 252. The higher boiling portion 258 can correspond to any convenient higher boiling stream that could be formed by separation of the gas phase pyrolysis fraction. For example, the higher boiling portion 258 can be a $C_{2+}$ fraction, a $C_{5+}$ fraction, or another convenient higher boiling fraction. The higher boiling portion 258 can then be passed into a second thermal cracking stage 260, such as a steam cracking stage. This can produce on olefin-containing effluent 265. The olefin-containing effluent 265 can be passed into final separation stage 270 for separating out one or more olefin products.

At least a portion of the liquid phase fraction 247 of the pyrolysis effluent can also be introduced into the second thermal cracking stage 260. In aspects where second thermal cracking stage 260 corresponds to steam cracking (or another type of pyrolysis where it is desirable to limit the boiling range of the feed), the liquid phase fraction 247 can be passed into a stage 280 for separation of high molecular weight and/or high boiling components. This can generate a heavy fraction 288 containing the high molecular weight and/or high boiling components. Optionally, at least a portion of heavy fraction 288 (i.e., the high molecular weight portion of the pyrolysis product) can be recycled to the pyrolysis reactor for further cracking. The remaining portion 285 of the liquid phase fraction can then be passed into second thermal cracking stage 260. Optionally, contaminant removal can also be performed on the liquid phase fraction 247 and/or the remaining portion 285 (not shown).

A configuration such as FIG. 2 provides examples of both direct fluid communication and indirect fluid communication between elements of the configuration. For example, the gas-liquid separation stage 240 shown in FIG. 2 is in direct fluid communication with pyrolysis reactor 220 and contaminant removal stage 250. It is noted that gas-liquid separation stage 240, as shown in FIG. 2, includes one or more cooling stages. If such cooling stage(s) were represented separately from the gas-liquid separation stage in FIG. 2, then the gas-liquid separation stage 240 would be in indirect fluid communication with pyrolysis reactor 220 via the separate cooling stage(s) (not shown).

Additional Embodiments

Embodiment 1. A method for producing olefins, comprising: melting a plastic feedstock comprising plastic particles of at least one polymer in a melt extruder; transferring the melted plastic feedstock from the melt extruder to a pyrolysis reactor; pyrolyzing the transferred plastic feedstock in a fluidized bed of heat transfer particles in the pyrolysis reactor at a temperature of 400° C. or more to form a pyrolysis effluent; cooling the pyrolysis effluent to form a cooled pyrolysis effluent; separating the cooled pyrolysis effluent to form a gas phase fraction and a liquid phase fraction; and performing a second thermal cracking on a) at least a portion of the gas phase fraction, b) at least a portion of the liquid phase fraction, or c) a combination thereof, in a second thermal cracking stage to form an olefin-containing effluent.

Embodiment 2. The method of Embodiment 1, wherein the plastic feedstock is melted at a temperature of 150° C. or more.

Embodiment 3. The method of any of the above embodiments, wherein transferring the melted plastic feedstock comprises transferring the melted plastic feedstock from the melt extruder to the pyrolysis reactor through a transfer conduit, the method optionally further comprising heating the transfer conduit to maintain a temperature of the melted plastic feedstock at 150° C. or more.

Embodiment 4. The method of Embodiment 3, wherein transferring the melted plastic feedstock from the melt extruder to the pyrolysis reactor comprises extruding the melted plastic feedstock through a die at an interface between the transfer conduit and the pyrolysis reactor.

Embodiment 5. The method of any of the above embodiments, wherein transferring the melted plastic feedstock comprises transferring a combined feedstock comprising the melted plastic feedstock and a recycled liquid portion of the olefin-containing effluent.

Embodiment 6. The method of any of the above embodiments, further comprising forming the plastic feedstock by physically processing plastic particles to reduce a median particle size of the plastic particles to 3.0 cm or less, the method optionally further comprising forming the plastic particles by physically processing bulk plastic.

Embodiment 7. The method of any of the above embodiments, wherein the at least a portion of the gas phase fraction comprises a $C_{5+}$ portion of the gas phase fraction, the method optionally further comprising passing at least a second portion of the gas phase fraction into the screw feeder as a sweep gas.

Embodiment 8. The method of any of the above embodiments, A) wherein the plastic feedstock further comprises calcium oxide particles; B) wherein the method further comprises withdrawing a portion of the heat transfer particles from the pyrolysis reactor; regenerating the withdrawn portion of the heat transfer particles in a regenerator to form heated heat transfer particles; passing at least a portion of the heated heat transfer particles into the pyrolysis reactor, the heat transfer particles optionally comprising calcium oxide; or C) a combination of A) and B).

Embodiment 9. The method of any of the above embodiments, further comprising performing contaminant removal on the gas phase fraction, the at least a portion of the gas phase fraction, or a combination thereof to reduce a concentration of at least one of Cl, N, and Hg in the gas phase fraction, the at least a portion of the gas phase fraction, or a combination thereof.

Embodiment 10. The method of any of the above embodiments, further comprising separating the liquid phase fraction to form the at least a portion of the liquid phase fraction and a second fraction comprising a higher T50 boiling point than the at least a portion of the liquid phase fraction; and recycling at least a portion of the second fraction to the pyrolysis reactor.

Embodiment 11. The method of any of the above embodiments, wherein performing the second thermal cracking on the a) at least a portion of the gas phase fraction, b) the at least a portion of the liquid phase fraction, or c) a combination thereof, further comprises performing the second thermal cracking on a liquid steam cracker feedstock, the liquid steam cracker feedstock optionally being mixed with the at least a portion of the gas phase fraction, the at least a portion of the liquid phase fraction, or a combination thereof prior to entering the second thermal cracking stage.

Embodiment 12. A system for olefin production, comprising: a physical processing stage for forming a plastic feedstock comprising plastic particles; a melt extruder in fluid communication with the physical processing stage via a transfer conduit; a pyrolysis reactor comprising a pyrolysis inlet and a pyrolysis outlet, the pyrolysis reactor being in fluid communication with the melt extruder at an interface between the transfer conduit and the pyrolysis inlet, the interface comprising an extrusion die; a regenerator in fluid communication with the pyrolysis reactor; a cooling stage in fluid communication with the pyrolysis outlet; a separation stage comprising a separation stage inlet, a gas effluent outlet, and a liquid effluent outlet, the separation stage inlet being in fluid communication with the cooling stage; a steam cracking reactor comprising a reactor inlet and a reactor outlet, the reactor inlet being in fluid communication with at least one of the gas effluent outlet and the liquid effluent outlet.

Embodiment 13. The system of Embodiment 12, further comprising a contaminant removal stage, the reactor inlet being in indirect fluid communication with the gas effluent outlet via the contaminant removal stage, the regenerator optionally further comprising a regenerator fuel inlet in fluid communication with the contaminant removal stage.

Embodiment 14. The system of Embodiment 12 or 13, wherein the system further comprises a liquid separation stage, the reactor inlet being in indirect fluid communication with the liquid effluent outlet via the liquid separation stage.

Embodiment 15. The system of any of Embodiments 12 to 14, wherein the pyrolysis outlet is in indirect fluid communication with the pyrolysis inlet.

Additional Embodiment A. The method of any of Embodiments 1 to 11, i) wherein the feedstock comprises 0.01 wt % to 10 wt % polyvinyl chloride, polyvinylidine chloride, or a combination thereof; ii) wherein the feedstock comprises 0.01 wt % to 35 wt % polystyrene; iii) wherein the feedstock comprises 0.1 wt % to 1.0 wt % polyamide; or iv) a combination of two or more of i), ii), and ii).

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for producing olefins, comprising:

melting a plastic feedstock comprising plastic particles of at least one polymer in a melt extruder;

adding a hydrocarbon stream to the plastic feedstock to reduce its viscosity before initial extrusion and form a combined plastic feedstock that comprises from 75 wt % to 95 wt % of the plastic feedstock and from 5 wt % to 25 wt % of the hydrocarbon stream;

heating an extruder barrel to maintain the melted plastic feedstock in a liquid state;

transferring the liquid melted plastic feedstock from the melt extruder to a pyrolysis reactor;

pyrolyzing the transferred liquid plastic feedstock in a fluidized bed of heat transfer particles in the pyrolysis reactor at a temperature of 400° C. or more to form a pyrolysis effluent;

cooling the pyrolysis effluent to form a cooled pyrolysis effluent;

separating the cooled pyrolysis effluent to form a gas phase fraction and a liquid phase fraction;

performing a second thermal cracking on a) at least a portion of the gas phase fraction, b) at least a portion of the liquid phase fraction, or c) a combination thereof, in a second thermal cracking stage to form an olefin-containing effluent, wherein the hydrocarbon stream comprises recycled liquid from the pyrolysis reactor and/or from the second thermal cracking;

performing contaminant removal on the gas phase fraction, the at least a portion of the gas phase fraction, or a combination thereof to reduce a concentration of at least one of Cl, N, and Hg in the gas phase fraction, the at least a portion of the gas phase fraction, or a combination thereof; and using at least a portion of the gas phase fraction as additional fuel in a regenerator to heat the pyrolysis reactor.

2. The method of claim 1, wherein the plastic feedstock is melted at a temperature of 150° C. or more.

3. The method of claim 1, wherein transferring the melted plastic feedstock comprises transferring the melted plastic feedstock from the melt extruder to the pyrolysis reactor through a transfer conduit.

4. The method of claim 3, wherein transferring the melted plastic feedstock from the melt extruder to the pyrolysis reactor comprises extruding the melted plastic feedstock through a die at an interface between the transfer conduit and the pyrolysis reactor.

5. The method of claim 3, further comprising heating the transfer conduit to maintain a temperature of the melted plastic feedstock at 150° C. or more.

6. The method of claim 1, wherein transferring the melted plastic feedstock comprises transferring a combined feedstock comprising the melted plastic feedstock and a recycled liquid portion of the olefin-containing effluent.

7. The method of claim 1, further comprising forming the plastic feedstock by physically processing plastic particles to reduce a median particle size of the plastic particles to 3.0 cm or less.

8. The method of claim 1, further comprising forming the plastic particles by physically processing bulk plastic.

9. The method of claim 1, further comprising passing the plastic feedstock into the melt extruder using a screw feeder.

10. The method of claim 1, wherein the at least a portion of the gas phase fraction comprises a $C_{5+}$ portion of the gas phase fraction.

11. The method of claim 1, wherein the plastic feedstock further comprises calcium oxide particles.

12. The method of claim 1, further comprising:

withdrawing a portion of the heat transfer particles from the pyrolysis reactor;

regenerating the withdrawn portion of the heat transfer particles in a regenerator to form heated heat transfer particles;

passing at least a portion of the heated heat transfer particles into the pyrolysis reactor.

13. The method of claim 12, wherein the heat transfer particles comprise calcium oxide, at least a portion of the calcium oxide being converted to calcium chloride under the pyrolysis conditions.

14. The method of claim 12, further comprising passing at least a third portion of the gas phase fraction into the regenerator, the third portion of the gas phase fraction comprising hydrocarbons.

15. The method of claim 1, wherein the second thermal cracking comprises steam cracking.

16. The method of claim 15, further comprising separating the liquid phase fraction to form the at least a portion of the liquid phase fraction and a second fraction comprising a higher T50 boiling point than the at least a portion of the liquid phase fraction.

17. The method of claim 15, further comprising recycling at least a portion of the second fraction to the pyrolysis reactor.

18. The method of claim 17, wherein performing the second thermal cracking on the a) at least a portion of the gas phase fraction, b) at least a portion of the liquid phase fraction, or c) a combination thereof, further comprises performing the second thermal cracking on a liquid steam cracker feedstock.

19. The method of claim 18, wherein the liquid steam cracker feedstock is mixed with the a) at least a portion of the gas phase fraction, b) at least a portion of the liquid phase fraction, or c) a combination thereof prior to entering the second thermal cracking stage.

20. The method of claim 1, i) wherein the feedstock comprises 0.01 wt % to 10 wt % polyvinyl chloride, polyvinylidine chloride, or a combination thereof; ii) wherein the feedstock comprises 0.01 wt % to 35 wt % polystyrene; iii) wherein the feedstock comprises 0.1 wt % to 1.0 wt % polyamide; or iv) a combination of two or more of i), ii), and ii).

21. The method of claim 1, wherein multiple extruders are used to introduce the plastic feedstock into the pyrolysis reactor to assist in evenly distributing a delivery of the plastic feed into the pyrolysis reactor, and wherein the multiple extruders are arranged in a symmetric manner around a circumference of the pyrolysis reactor.

22. The method of claim 3, wherein the transfer conduit is horizontal relative to a direction of gravitational force.

23. The method of claim 1, further returning at least a portion of the gas phase fraction to the pyrolyzing for use as a fluidizing gas.

24. The method of claim 1, further performing contaminant removal on the at least a portion of the liquid phase fraction.

* * * * *